US006006838A

United States Patent [19]

Whiteley et al.

[11] Patent Number: 6,006,838

[45] Date of Patent: Dec. 28, 1999

[54] APPARATUS AND METHOD FOR STIMULATING MULTIPLE PRODUCTION ZONES IN A WELLBORE

[75] Inventors: T. G. Whiteley, Houston; Douglas J. Lehr, Woodlands; Michael A. Martin; Dennis Atchley, both of Midland, all of Tex.

[73] Assignee: BJ Services Company, Houston, Tex.

[21] Appl. No.: 09/169,910

[22] Filed: Oct. 12, 1998

[51] Int. Cl.[6] ..... E21B 43/25

[52] U.S. Cl. ..... 166/306; 166/318

[58] Field of Search ..... 166/306, 307, 166/318, 319, 222, 177.5

[56] References Cited

U.S. PATENT DOCUMENTS

| | | | |
|---|---|---|---|
| 2,327,051 | 7/1943 | Lyons et al. | 166/222 |
| 2,997,108 | 5/1961 | Sievers | 166/222 |
| 3,912,173 | 10/1975 | Robichaux | 239/443 |
| 4,043,392 | 8/1977 | Gazda | 166/217 |
| 5,135,051 | 8/1992 | Facteau et al. | 166/104 |
| 5,165,438 | 11/1992 | Facteau et al. | 137/1 |
| 5,181,569 | 1/1993 | McCoy et al. | 166/317 |
| 5,228,508 | 7/1993 | Facteau et al. | 166/177 |
| 5,462,129 | 10/1995 | Best et al. | 175/67 |
| 5,533,571 | 7/1996 | Surjaatmadja et al. | 166/222 |

*Primary Examiner*—William Neuder
*Assistant Examiner*—John Kreck
*Attorney, Agent, or Firm*—Arnold White & Durkee

[57] ABSTRACT

An apparatus and method for selectively stimulating a plurality of producing zones of an openhole wellbore in oil and gas wells in one trip. The assembly includes a plurality of modules connected in a tailpipe wherein the modules can be selectively actuated to conduct a matrix acidizing job and near wellbore erosion job on producing zones of interest in the wellbore. Each module includes a sleeve shiftable between a closed position and a treating position where a plurality of jet passageways are exposed to the central passageway of the assembly.

29 Claims, 3 Drawing Sheets

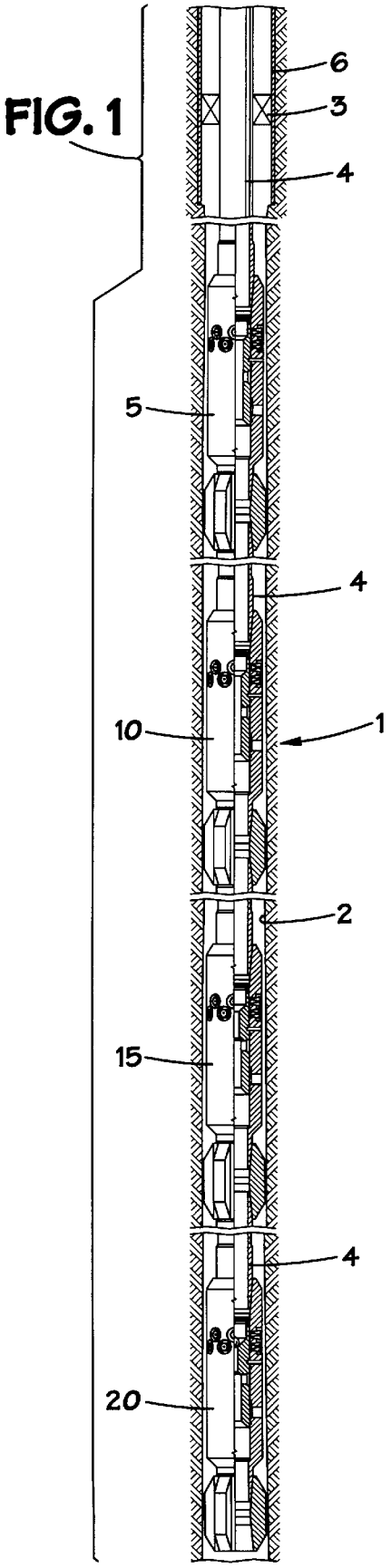
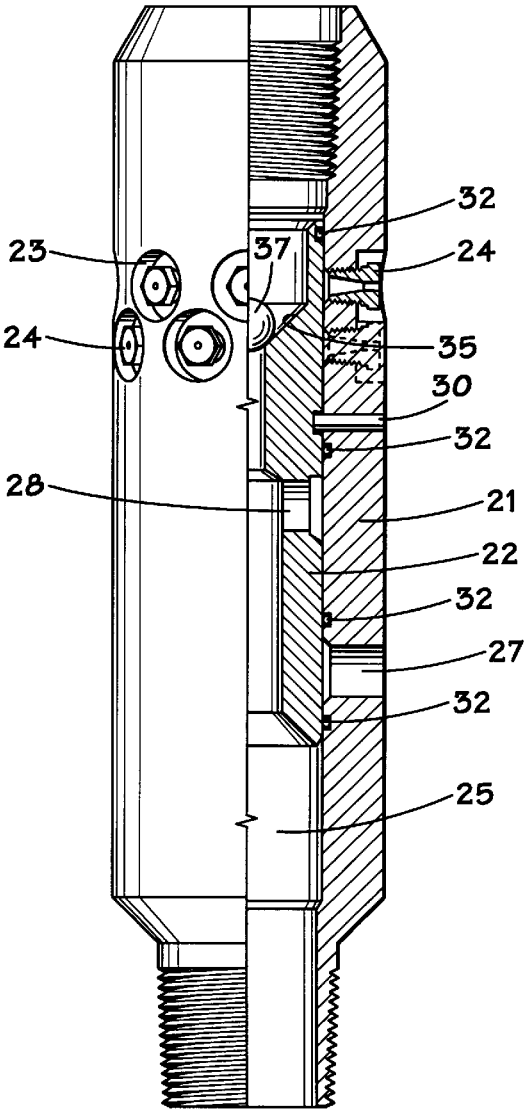
FIG. 2

APPARATUS AND METHOD FOR STIMULATING MULTIPLE PRODUCTION ZONES IN A WELLBORE

BACKGROUND OF THE INVENTION

This invention relates to an apparatus and method for stimulating producing zones of an openhole wellbore in oil and gas wells. More particularly, the invention relates to an assembly for selectively stimulating a wellbore without the use of openhole inflatable packers. The assembly is especially suited to perform a combination of matrix acidizing jobs and near wellbore erosion jobs at a number of producing zones in the wellbore in a single trip.

Previously, operators who were interested in stimulating multiple producing zones in an openhole wellbore could stimulate the zones one zone at a time by using a workstring and an openhole inflatable packer. Such a method and assembly required the operator to set an inflatable packer (or other similar apparatus) above each zone of interest to be stimulated and then, following the stimulation job, to release the packer (or packers) and trip the packer assembly to a new location where it would be reset for the next stimulation job. This procedure would be repeated for each desired zone of interest. However, because of the tripping time and the difficulty in setting and maintaining the seal in inflatable packers in openhole wellbores, such a method was both time consuming and relatively unreliable. Furthermore, openhole inflatable packers (or other similar devices) are expensive to rent or to purchase. As a result of the relative unreliability and cost of using openhole inflatable packers, such assemblies prove to be uneconomical in marginal fields such as fields in the Permian Basin region of West Texas and Eastern New Mexico.

The assembly of the present invention does not require an inflatable packer and is very economical to build and maintain. Thus, an operator can use the present invention for a small incremental cost over what it costs to perform an acid job and receives the benefits of not only a matrix acidizing treatment, but can also enhance the flow in the near wellbore region by eroding away near wellbore skin damage. In addition, the present invention allows an operator to accurately position an assembly in a wellbore to ensure that the producing zones of interest are stimulated.

SUMMARY OF THE INVENTION

One embodiment of the present invention is directed to an assembly for selectively stimulating a plurality of producing zones in an oil and gas well comprising a tailpipe string, a plurality of modules spaced in the tailpipe string at predetermined locations, wherein each module comprises a housing having a central passageway therethrough, a plurality of jetting passageways extending radially through the housing, and a shifting sleeve slidably mounted within the housing wherein the shifting sleeve is moveable from a closed position over the jet passageways to an open position whereby the jet passageways are in communication with the central passageway of the housing and wherein the shifting sleeve includes a ball seat for receiving an actuating ball for shifting the shifting sleeve from the closed position to the open position. The lowermost module in the assembly is adapted to receive an actuating ball and each successive module in the assembly is adapted to receive a larger actuating ball than the module immediately below it. The size of the ball seat will differ from module to module with the lowermost module having the smallest ball seat and each successive module in the assembly will have a larger ball seat than the module immediately below it. Each of the jet passageways may include a jet nozzle.

In another embodiment, the housing may include an interchangeable nozzle body wherein the jet passageways extend radially through the nozzle body. The housing may further comprise a top sub connected to the upper end of the nozzle body and a bottom sub connected to the lower end of the nozzle body.

Each module may further comprise one or more radially extending flow ports in the shifting sleeve beneath the ball seat which communicates with one or more flow ports in the housing when the shifting sleeve is in the open position.

Another embodiment of the present invention is directed to an assembly for selectively stimulating a plurality of producing zones in an oil and gas well comprising a plurality of modules connected in a tailpipe string wherein each module comprises a housing having a central passageway therethrough, one or more jetting passageways extending radially through the housing, and a shiftable sleeve mounted in the central passageway of the module, wherein the shiftable sleeve is moveable from a closed position over the jet passageways to an open position whereby the jet passageways are in communication with the central passageway of the housing, and wherein the shiftable sleeve is adapted to receive an actuating means for shifting the shiftable sleeve from the closed position to the open position. The actuating means may include balls, darts, bars, plugs or similar devices.

BRIEF DESCRIPTION OF THE DRAWINGS

1.) FIG. 1 illustrates a partial cutaway of an assembly for selectively stimulating a plurality of producing zones in an openhole wellbore.

2.) FIG. 2 shows a partial cutaway of one embodiment of a module used in the assembly shown in FIG. 1.

3.)

4.)

DESCRIPTION OF ILLUSTRATIVE EMBODIMENTS

The illustrative embodiments described herein provide an apparatus and method for selectively stimulating multiple production zones or intervals within a subterranean oil or gas well in a single trip. Persons of ordinary skill in the art, having the benefit of the present disclosure, will recognize that the teachings of the present disclosure will find application in any number of alternative embodiments employing the general teachings of the illustrative embodiments. Therefore, the described directstem assembly and method of using the same to selectively stimulate producing zones in a wellbore are meant to be illustrative and not limiting. Accordingly, while the present invention is well-suited for use in horizontal wellbores, the invention is only illustrated in the accompanying drawings in a substantially vertical wellbore. Persons of ordinary skill in the art will understand that terms such as "lowermost" and "uppermost" in terms of horizontal wellbores are relative indications of the distance or depth from the surface location of the wellbore.

Figure 3:
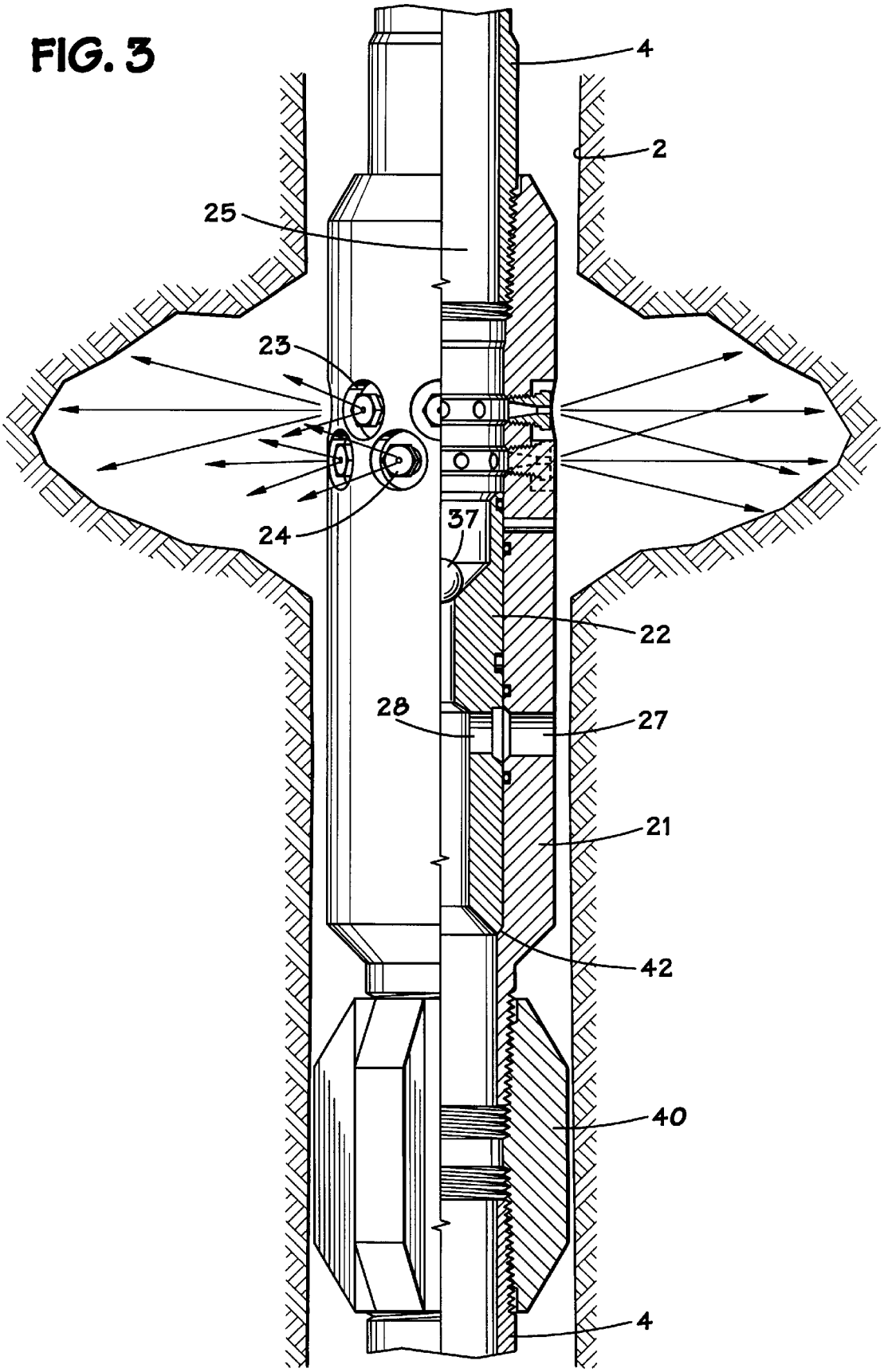
FIG. 3 illustrates the module of FIG. 2 with the shifting sleeve in the open position.

Referring to FIGS. 1–3, a preferred embodiment of an assembly for selectively stimulating producing zones in a subterranean wellbore will now be described. The directstem assembly 1 includes a plurality of modules which are attached to a tailpipe 4 (shown in cutaway to reflect the longitudinal distance between the modules). The assembly in FIG. 1 includes modules 5, 10, 15 and 20. Tailpipe 4 is suspended from service packer 3 which is set inside casing 6, above the openhole wellbore 2. The service packer may be, for example, a compression packer, such as an SD-1 or MR1220 packer available from BJ Services Company. A workstring of tubing, drillpipe or the like extends from packer 3 to the surface. The tailpipe string, being suspended from packer 3, extends into the openhole beneath the casing shoe. In a preferred embodiment, modules 5, 10, 15 and 20 are spaced in the tailpipe string at predetermined locations so that an individual module is adjacent a producing zone desired to be stimulated. The tailpipe string may be comprised of tubing, drillpipe or the like and the length of tailpipe between adjacent modules will depend on the distance between the producing zones or targets of interest. Alternatively, it will be understood that the packer could be reset at different locations in the casing to locate one or more modules of the assembly adjacent one or more producing zones or targets of interest. In other words, the entire assembly can be repositioned within the wellbore to more accurately position some of the modules without tripping the assembly out of the wellbore.

As shown in FIG. 2, each module comprises a generally tubular-shaped housing 21 which includes a threaded upper and lower end for connecting the module to the tailpipe string. Central passageway 25 extends longitudinally through housing 21. Each module includes shifting sleeve 22 which is adapted for longitudinal movement along the inner wall of housing 21. Shifting sleeve 22 includes one or more radially extending ports 28 which are arranged about the circumference of the sleeve. Housing 21 also includes one or more radially extending ports 27 circumferentially spaced about the housing. The number of ports 28 in shifting sleeve 22 will correspond to the number of flow ports 27 in housing 21. Shifting sleeve 22 includes a landing seat or ball seat 35. The size of ball seat 35 will differ from module to module in the assembly, with the lowermost module 20 having the smallest ball seat and the uppermost module 5 having the largest ball seat.

Housing 21 may include a plurality of nozzle holes 23 which extend radially through the wall of housing 21 for receiving interchangeable jet nozzles 24. Jet nozzles 24 may be held in nozzle holes 23 by any suitable means such as mating threads, snap rings, welding or the like. Jet nozzles may come in a wide variety of orifice sizes. The size of the nozzle orifice may be predetermined to achieve the desired fluid hydraulics for a particular acid job. Some of nozzle holes may be selectively blanked off to achieve the optimum flow rates and pressure drops across the remaining nozzles. In general, the number and size of the working jet nozzles will reflect the desired kinetic energy to be used in treating a given producing zone.

Shifting sleeve 22 is initially attached to housing 21 in the closed position by one or more shear screws 30 so that the shifting sleeve straddles jet holes 23, jet nozzles 24 and fluid flow ports 27. Seals 32 seal the annular space between shifting sleeve 22 and housing 21. Elastomeric seals 32 may be o-ring seals, molded seals or other commonly used oilfield seals. The remaining components of the module may be manufactured from common oilfield materials, including various steel alloys.

As shown in FIG. 3, centralizing coupling 40 may be attached to the lowermost end of housing 21. Centralizing coupling 40 not only connects the module to lower tailpipe 4 but also centralizes the module and assembly in the wellbore. Centralizing coupling 40 includes a plurality of centralizing ribs, with adjacent fluid flow passageways therebetween.

As shown in FIG. 1, an assembly for selectively stimulating a plurality of intervals or targets in a wellbore includes a plurality of modules assembled in a tailpipe string. By varying the length of tailpipe between modules, an operator can space the individual modules so that a module is adjacent each desired producing interval or target to be stimulated. The selectivity is provided by varying the size of the landing seat 35 on shifting sleeve 22. The lowermost module 20 will have the smallest ball seat 35, i.e., the smallest internal diameter of any of the modules, for catching the smallest ball. The next to last module in the assembly will have a slightly larger ball seat 35 and so on until the uppermost module, which will have the largest ball seat, i.e., the largest internal diameter of any of the modules. Thus, the actuating balls for the assembly will increase in diameter as one moves from the lowermost module to the uppermost module.

In operation, the assembly of FIG. 1 is run into the wellbore suspended from packer 3. The packer is set in the production casing near the casing shoe at a predetermined location. Tailpipe 4 and modules 5, 10, 15 and 20 extend beneath the casing shoe into the open hole. The modules are spaced apart in the tailpipe string so that each particular module will be adjacent to a producing zone that the operator desires to stimulate. The stimulation treatment begins with the lowermost zone and works its way up the wellbore. An appropriate sized ball is dropped or pumped down the workstring and into the assembly until it lands on seat 35 of shifting sleeve 22 in the lowermost module 20. Pressure is increased inside the work string and assembly until the force acting across the actuating ball and ball seat exceeds the shear value for shear screw 30. Once shear screw 30 is sheared, shifting sleeve 22 is shifted downward to the treating position against shoulder 42 of housing 21. As shown in FIG. 3, when the shifting sleeve is in the open or treating position, jet nozzles 24 are in communication with central passageway 25. Once landed, ball 37 prevents acid from passing out the bottom of the assembly. Acid is then pumped at a desired rate through jet nozzles 24 to acidize and erode the wellbore adjacent the jet nozzles. The kinetic energy created by pumping the acid through the jet nozzles mechanically erode away the near wellbore formation damage adjacent the nozzles as illustrated in FIG. 3.

Upon completion of the acid stimulation treatment of the lowermost zone or target, a slightly larger ball is dropped or pumped down the workstring into the assembly where it passes through the upper modules and lands on the ball seat of module 15. Pressure is again increased inside the workstring to shift the shifting sleeve from the closed position to the open position so that the jet nozzles of module 15 are exposed. Acid is then pumped through the jet nozzles of module 15 to acidize and erode the wellbore adjacent the module. The ball in module 15 prevents acid from flowing down to module 20.

The remainder of the zones of interest or targets are selectively acidized or treated by dropping or pumping successively larger balls into the assembly and repeating the above-described sequence. Upon completion of the stimulation treatment of all zones, the packer can be released from the production casing and the assembly can be pulled out of the well.

The assembly allows an operator to selectively stimulate a number of producing zones in a wellbore in a single trip.

By dropping successively larger actuating balls, an operator can shift a sleeve in successive modules and then squeeze and jet a desired volume of hydrochloric acid or other type of acid into the producing zones of the interest. By diverting the acid through the nozzles in the modules, the acid will impact the wellbore at high velocity under squeezed pressures. The kinetic energy of the acid will erode away the wellbore and thereby create a cavern in addition to penetrating the formation rock with the acid. The acidizing and wellbore erosion will enhance the ability of oil or other hydrocarbons to flow into the wellbore at these locations. The wellbore is thus treated both mechanically and chemically by dissolving materials that are plugging the pores of the formation rock, such as fines, paraffins, or clays or other materials that have reduced the porosity and/or permeability of the formation. By jetting a large cavern at the face of the wellbore, the resistance to the flow of oil or gas into the wellbore is reduced. Although not limited to such application, the present invention is well suited for stimulating a calcareous formation with, for example, hydrochloric acid.

Figure 4:
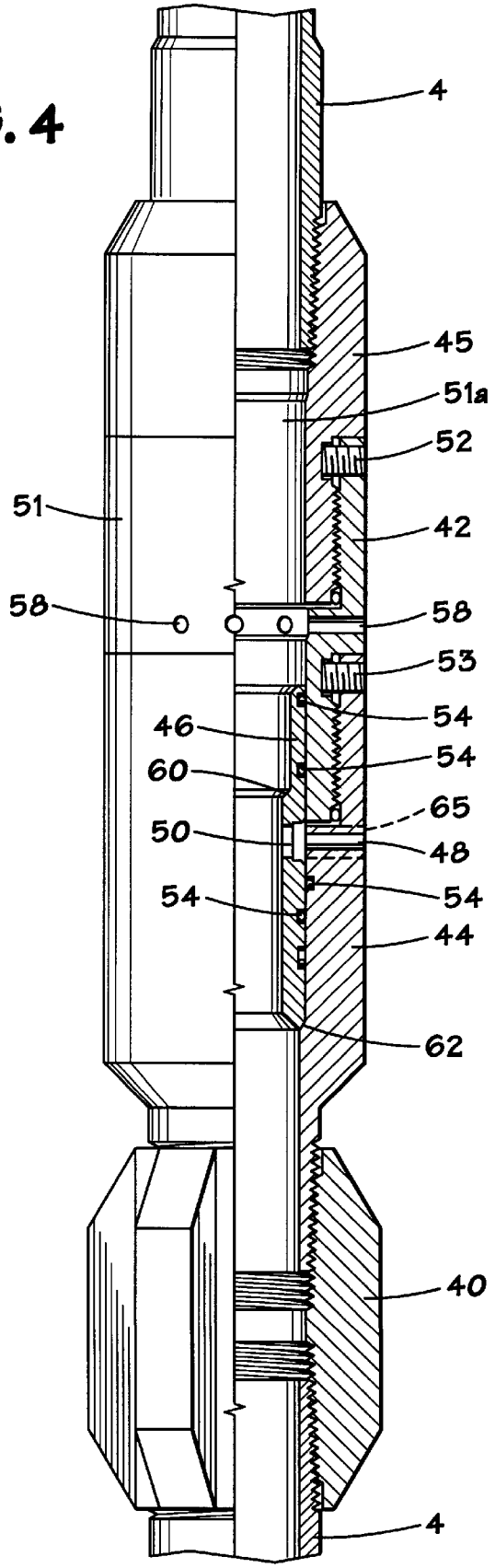
FIG. 4 shows a partial cutaway of an alternative embodiment of a module for use in an assembly for selectively stimulating a plurality of producing zones in a wellbore.

An alternative embodiment of a module for use in an assembly of the present invention is shown in FIG. 4. The module has a generally tubular shaped housing 51 comprising top sub 45, nozzle body 42, and bottom sub 44. Central passageway 51 extends longitudinally through the module. The upper portion of top sub 45 includes internal threads for connecting the module to upper tailpipe 4. Top sub 45 includes external threads on its lower end for connecting top sub 45 to nozzle body 42. Nozzle body 42 includes internal threads for mating with the external threads of top sub 45. Nozzle body 42 also includes external threads on its lowermost end for mating with internal threads on the upper end of bottom sub 44. Bottom sub 44 includes threads on its lowermost end for mating with internal threads on centralizing coupling 40. Centralizing coupling 40 is threadedly attached to the lower tailpipe 4.

Nozzle body 42 may be further secured to top sub 45 by one or more set screws 52. Similarly, nozzle body 42 may be further secured to bottom sub 44 by one or more set screws 53. Nozzle body 42 has a plurality of radially extending nozzle ports 58 drilled therethrough. The nozzle ports 58 extend about the circumference of nozzle body 42. The number and size of nozzle ports 58 may vary from module to module depending on the fluid flow characteristics required for the stimulation treatment at each desired producing zone. By way of example, nozzle body 42 may include eight nozzle ports ranging in diameter from 1/16 to 3/16 of an inch spaced approximately 45 degrees apart about the circumference of the nozzle body.

Shifting sleeve 46 is adapted for longitudinal movement along the inner wall of housing 51. Sleeve 46 includes one or more radically extending flow ports 50. The annular space between shifting sleeve 46 and the inner walls of top sub 45, nozzle body 42, and bottom sub 44 is sealed by a plurality of seals 54. Sleeve 46 is shifted from a closed position straddling nozzle ports 58 to the stimulating position shown in FIG. 4 by landing an appropriately sized shifting ball (not shown) on ball seat 60. Sleeve 46 is initially held in the closed position by one or more shear screws 48. After a shifting ball lands on seat 60 (not shown), the tubular pressure is increased until shear screws 48 shear allowing shifting sleeve 46 to be longitudinally moved downward to the stimulating position. Shoulder 62 may be provided to stop the downward movement of sleeve 46. In the stimulating position, flow ports 50 are aligned with a corresponding number of flow ports 65 in bottom sub 44, as shown by the dotted line. Flow ports 65 extend radially through the bottom sub and are spaced, for example, 45 degrees apart from shear screws 48 along the same plane.

An operator can change the size and number of nozzle ports in a module by using interchangeable nozzle bodies 42. The interchangeable nozzle bodies provide an operator an alternative to the use of interchangeable jet nozzles as described in the embodiment of FIG. 2. Nozzle body 42 may be made of a variety of steel alloys commonly used in the oil industry or may be made of high chromium materials or heat treated metals to increase the erosion resistance of nozzle ports 58. The remaining portions of the module, including top sub 45, bottom sub 44 and shifting sleeve 46, can be made of a variety of steel alloys commonly used in the oil field.

Although different embodiments of a module are illustrated in FIGS. 2 and 4, the method of selectively actuating the different modules of an assembly can be more readily understood by comparing the respective ball seats of the modules in these figures. As can be seen, the internal diameter of ball seat 60 in the module of FIG. 4 is substantially larger than the internal diameter of ball seat 35 in the module of FIG. 2. Thus, the actuating ball for seat 35 will easily pass through ball seat 60 and continue through the assembly until it lands on seat 35 of the lower module. Therefore, an operator can selectively actuate the modules in the assembly from the bottom up by dropping or displacing progressively larger actuating balls into the assembly, thereby allowing the operator to selectively stimulate a plurality of producing zones in a single trip.

Although the embodiments described above are actuated by using successively larger balls, it should be readily understood that the modules can be actuated by other means. For example, the shifting sleeves of the modules could be easily adapted to be actuated by dropping or pumping down the assembly appropriately sized darts, bars, plugs, or the like. Alternatively, each shiftable sleeve may include a selective profile, such as an Otis "X" or "R" style profile, and the actuating means for a particular sleeve would include a locking mechanism with a mating profile. In such an embodiment, the actuating means would pass through all modules except the module that had a shifting sleeve with a mating profile.

Other numerous changes in the details of construction and arrangement of parts will be readily apparent to those skilled in the art and which are encompassed within the spirit of the invention and the scope of the appended claims.

What is claimed is:

1. An assembly for selectively stimulating a plurality of producing zones in an oil and gas well comprising:

a tailpipe string, a plurality of modules spaced in the tailpipe string at predetermined locations, wherein each module comprises a housing having a central passageway therethrough, a plurality of jetting passageways extending radially through each housing, and a shifting sleeve slidably mounted within each housing, wherein the shifting sleeve is moveable from a closed position over the jetting passageways to an open position whereby the jetting passageways are in communication with the central passageway of each housing, and wherein the shifting sleeve includes a ball seat for receiving an actuating ball for shifting the shifting sleeve from the closed position to the open position.

2. The assembly of claim 1 wherein the lowermost module is adapted to receive an actuating ball and each successive module in the assembly is adapted to receive a larger actuating ball than the module immediately below it.

3. The assembly of claim 1 wherein the size of the ball seat will differ from module to module, with the lowermost module having the smallest ball seat and each successive module in the assembly having a larger ball seat than the module immediately below it.

4. The assembly of claim 1 wherein each of the jetting passageways includes a jet nozzle.

5. The assembly of claim 1 wherein each housing further comprises a nozzle body and wherein the jetting passageways extend radially through the nozzle body.

6. The assembly of claim 5 wherein each housing further comprises a top sub connected to the upper end of the nozzle body and a bottom sub connected to the lower end of the nozzle body.

7. The assembly of claim 1 further comprising one or more radially extending flow ports in each shiftable sleeve beneath the ball seat which communicates with one or more flow ports in the housing on which the shiftable sleeve is mounted when the shifting sleeve is in the open position.

8. An assembly for selectively stimulating a plurality of producing zones in an oil and gas well comprising:

a plurality of modules connected in a tailpipe string, wherein each module comprises a housing having central passageway therethrough, one or more jetting passageways extending radially through the housing, and a shiftable sleeve mounted in the central passageway of the module, wherein the shiftable sleeve is moveable from a closed position over the jetting passageways to an open position whereby the jetting passageways are in communication with the central passageway of the housing, and wherein the shiftable sleeve is adapted to receive an actuating means for shifting the shiftable sleeve from the closed position to the open position.

9. The assembly of claim 8 wherein the lowermost module is adapted to receive an actuating means and each successive module in the assembly is adapted to receive a larger actuating means than the module immediately below it.

10. The assembly of claim 8 wherein the actuating means are balls, darts, bars or plugs.

11. The assembly of claim 8 wherein each of the jetting passageways includes a jet nozzle.

12. The assembly of claim 8 wherein each housing further comprises a replaceable nozzle body wherein the jetting passageways are drilled radially through the nozzle body.

13. The assembly of claim 8 wherein each shiftable sleeve has a selective profile engageable by a mating profile on the actuating means.

14. The assembly of claim 1 or claim 8 wherein each module further comprises a centralizing coupling connected to one end of the module.

15. The assembly of claim 1 or claim 8 wherein the tailpipe string is suspended from a casing packer.

16. A method of selectively stimulating a plurality of producing zones in an oil and gas well in a single trip comprising:

(A) positioning an assembly in the well, the assembly comprising a plurality of modules connected in a tailpipe string;

(i) wherein each module is adjacent a producing zone to be stimulated, each module comprising:

(a) a housing having a central passageway extending therethrough;

(b) one or more jetting passageways extending radially through the housing; and (c) a shiftable sleeve slidably mounted within the housing, wherein the shiftable sleeve is adapted to receive an actuating ball for shifting the shiftable sleeve from a closed position over the jetting passageways to an open position whereby the jetting passageways are in communication with the central passageway of the housing;

(B) selectively stimulating each of the producing zones in succession from the lowermost zone to the uppermost zone from the module adjacent each zone by successively moving the shiftable sleeve to the open position in each of the modules beginning with the lowermost module and finishing with the uppermost module by using a progressively larger actuating ball for each of the successive modules.

17. The method of claim 16 further comprising suspending the assembly in an open hole portion of the wellbore.

18. The method of claim 16 further comprising suspending the assembly from a packer and setting the packer inside a casing proximate to an open hole portion of the wellbore.

19. The method of claim 16 wherein said selectively stimulating step comprises acidizing one or more of the producing zones.

20. The method of claim 16 wherein said selectively stimulating step comprises jetting one or more of the producing zones to erode away near wellbore formation damage.

21. A method of stimulating multiple target zones within an oil and gas well in a single trip comprising:

(a) making up an assembly comprising a plurality of modules connected in a tailpipe string wherein each module comprises:

(i) a housing having a central passageway extending longitudinally therethrough;

(ii) one or more jetting passageways extending radially through the housing; and (iii) a shiftable sleeve mounted for axial movement within the housing, wherein the shiftable sleeve is adapted to be moved by an actuating means from a closed position to an open position, wherein the jetting passageways are sealed from the central passageways by the shiftable sleeve in the closed position and the jetting passageways are in communication with the central passageway when the shiftable sleeve is in the open position;

(b) positioning the modules in the assembly adjacent the target zones to be stimulated;

(c) moving the shiftable sleeve in the lowermost module to the open position with an actuating means and stimulating the target zone adjacent the module through the jetting passageways of the module;

(d) moving the shiftable sleeve in the next lowermost module in the assembly to the open position with an actuating means and stimulating the target zone adjacent the next lowermost module through the jetting passageways in the module;

(e) repeating step (d) until all target zones have been stimulated.

22. The method of claim 21 further comprising sizing the actuating means of step (d) to have a larger diameter than the actuating means of the next lowermost module.

23. The method of claim 21 further comprising adapting each successive module in the assembly to receive a larger actuating means than the module immediately below it.

24. The method of claim 22 further comprising suspending the assembly in an openhole portion of the wellbore.

25. The method of claim 24 further comprising suspending the assembly from a packer and setting the packer inside a casing proximate to the openhole portion of the wellbore.

26. The method of claim 25 further comprising resetting the packer at a different location inside the casing to position one or more of the modules adjacent one or more target zones to be stimulated.

27. The method of claim 21 further comprising acidizing one or more of the target zones.

28. The method of claim 21 further comprising jetting one or more of the target zones to erode away near wellbore formation damage.

29. The method of claim 28 further comprising jetting one or more of the producing zones through a jet nozzle located in each of the jetting passageways.

* * * * *

UNITED STATES PATENT AND TRADEMARK OFFICE

CERTIFICATE OF CORRECTION

PATENT NO. : 6,006,838
DATED : December 28, 1999
INVENTOR(S) : Gilmore et al.

It is certified that error appears in the above-identified patent and that said Letters Patent is hereby corrected as shown below:

Title page,
Item [75] Inventors, Please add the name of Jesse E. Cornwell, Santa Rosa, CA Signed and Sealed this Sixth Day of February, 2001

*Attest:*

Q. TODD DICKINSON

*Attesting Officer*

*Director of Patents and Trademarks*

UNITED STATES PATENT AND TRADEMARK OFFICE

CERTIFICATE OF CORRECTION

| | | |
|---|---|---|
| PATENT NO. | : | 6,006,838 |
| DATED | : | December 28, 1999 |
| INVENTOR(S) | : | T. G. Whiteley, Douglas J. Lehr, Michael A. Martin, and Dennis Atchley |

It is certified that error appears in the above-identified patent and that said Letters Patent is hereby corrected as shown below:

In Column 5, line 26, after the word "passageway," please delete "51" and replace it with --51a--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*